US009737449B1

(12) United States Patent
Howell

(10) Patent No.: US 9,737,449 B1
(45) Date of Patent: Aug. 22, 2017

(54) APPARATUS AND METHOD FOR COVERING A HOYER LIFT SLING

(71) Applicant: Annette Howell, Coweta, OK (US)

(72) Inventor: Annette Howell, Coweta, OK (US)

( * ) Notice: Subject to any disclaimer, the term of this patent is extended or adjusted under 35 U.S.C. 154(b) by 136 days.

(21) Appl. No.: 14/752,254

(22) Filed: Jun. 26, 2015

(51) Int. Cl.
*A61G 7/10* (2006.01)
*A61G 1/01* (2006.01)

(52) U.S. Cl.
CPC ..... *A61G 7/1051* (2013.01); *A61G 1/01* (2013.01); *A61G 7/10* (2013.01); *A61G 7/1001* (2013.01); *A61G 2200/32* (2013.01)

(58) Field of Classification Search
CPC ..... A61G 7/10; A61G 7/1001; A61G 7/1007; A61G 7/1009; A61G 7/1049; A61G 7/1051; A61G 7/1055; A61G 7/1073; A61G 2200/32; A61G 1/01; A61G 9/00
See application file for complete search history.

(56) References Cited

U.S. PATENT DOCUMENTS 1,741,717 A * 12/1929 Hunter ..... A61G 7/1015 5/85.1
1,977,944 A * 10/1934 Haskett ..... A61G 7/1015 5/200.1
1,981,666 A * 11/1934 Ridley ..... A61G 7/1009 4/456
3,099,842 A 8/1963 Lee
3,383,717 A 5/1968 Underwood
3,905,055 A 9/1975 Blair
4,627,119 A * 12/1986 Hachey ..... A61G 7/1015 5/85.1
4,723,327 A 2/1988 Smith
4,944,057 A 7/1990 Shaw
5,386,604 A * 2/1995 Ricketts ..... A61G 1/01 5/413 R (Continued)

FOREIGN PATENT DOCUMENTS

EP 2641578 9/2013

OTHER PUBLICATIONS

Internet Printout; http://www.phc-online.com/v/vspfiles/assets/images/sling-styles.gif; US.

*Primary Examiner* — Robert G Santos
*Assistant Examiner* — David R Hare
(74) *Attorney, Agent, or Firm* — Dennis D. Brown; Brown Patent Law, P.L.L.C.

(57) ABSTRACT

An assembly and a method for covering a Hoyer Lift sling. The sling assembly includes a cover positioned over a top side of a Hoyer lift sling. The cover has a hole therethrough which is positioned over the hole of the sling. A retaining sheet is attached to the cover and also has a hole therethrough which is positioned in alignment with the hole of the sling. In addition, a pad having a corresponding hole therethrough is preferably positioned between the sling and the cover. At least a portion of the retaining sheet is received through the hole of the pad and through the hole of the sling so that this portion of the retaining sheet is positioned beneath the bottom side of the sling. The cover on top of the sling and the portion of the retaining sheet beneath the sling each extend beyond the width of the sling and have outer edge portions which are attached together so that the sling and the pad are thereby retained between the cover and the retaining sheet.

9 Claims, 10 Drawing Sheets

(56) References Cited

U.S. PATENT DOCUMENTS

| | | | | | |
|---|---|---|---|---|---|
| 5,442,821 | A * | 8/1995 | Weeks | A61G 1/01 | 5/627 |
| 5,579,546 | A * | 12/1996 | Griskauskas | A61G 7/1023 | 5/627 |
| 5,615,426 | A * | 4/1997 | Hokett | A61G 7/1017 | 5/486 |
| 6,276,006 | B1 | 8/2001 | Hoit | | |
| 6,289,534 | B1 * | 9/2001 | Hakamiun | A61G 7/1017 | 5/83.1 |
| 6,578,210 | B2 | 6/2003 | Erickson | | |
| 6,637,610 | B1 | 10/2003 | Cheeseboro | | |
| 6,715,167 | B2 | 4/2004 | Wake | | |
| 7,222,378 | B2 * | 5/2007 | DuPree | A61G 10/005 | 5/625 |
| D622,399 | S * | 8/2010 | Veon | D12/128 | |
| 8,141,555 | B1 * | 3/2012 | Neusch | A61G 1/01 | 128/869 |
| 8,161,583 | B1 * | 4/2012 | Palen | A61G 7/001 | 5/81.1 HS |
| 8,657,373 | B2 | 2/2014 | Miles | | |
| 2002/0026134 | A1 | 2/2002 | Dalton | | |
| 2014/0259390 | A1 * | 9/2014 | Couch | A61G 7/1007 | 5/83.1 |
| 2015/0052681 | A1 * | 2/2015 | Hagler | A61G 7/1051 | 5/89.1 |

* cited by examiner

APPARATUS AND METHOD FOR COVERING A HOYER LIFT SLING

FIELD OF THE INVENTION

The present invention relates to apparatuses and methods for covering Hoyer Lift slings.

BACKGROUND OF THE INVENTION

Hoyer Lifts are commonly used to lift elderly or other bedridden patients. The lift includes a sling which is positioned beneath the patient. The sling has a hole provided therethrough in which the patient's bottom will be positioned. Unfortunately, the Hoyer Lift sling piece is too abrasive and too uncomfortable to be left under the patient. Consequently, the sling must be removed after each use and then repositioned under the patient when the lift is used again.

A need therefore exists for a cover or pad system for a Hoyer Lift sling piece which will permit the lift sling to be comfortably left in position under the patient between uses.

SUMMARY OF THE INVENTION

The present invention provides an apparatus and method for covering a Hoyer Lift sling. The inventive apparatus and method satisfy the needs and alleviate the problems discussed above.

In one aspect, there is provided a sling assembly for a Hoyer Lift comprising: (a) a sling for a Hoyer Lift having a hole therethrough for a patient's bottom; (b) a cover positioned over a top side of the sling, the cover having a hole therethrough which is positioned above the hole of the sling; and (c) a retaining sheet attached to the cover and having a hole therethrough which is positioned in alignment with the hole of the sling. At least a portion of the retaining sheet is received through the hole of the sling so that this portion of the retaining sheet is positioned beneath the bottom side of the sling.

In other aspects, it may also preferred that:

a. the retaining sheet be permanently attached to the cover around, or at least partially around, the hole of the retaining sheet;
b. the retaining sheet be permanently attached to the cover by sewing around, or at least partially around, the hole of the retaining sheet;
c. the cover which is positioned above the top side of sling and the portion of the retaining sheet which is positioned beneath the bottom side of the sling are each wider than the sling;
d. an outer edge portion of the retaining sheet be attached to an outer edge portion of the cover to retain the sling between the cover and the retaining sheet;
e. the outer edge portion of the retaining sheet be removably attachable to the outer edge portion of the cover by Velcro attachment;
f. the cover be padded;
g. a portion of the retaining sheet which surrounds the hole of the retaining sheet be positioned on and attached to a top side of the cover so that the portion of the retaining sheet which is received through the hole of the sling is also received through the hole of the cover;
h. the portion of the retaining sheet which surrounds the hole of the retaining sheet be sewn to the top side of the cover;

i. the sling assembly further comprise a pad positioned between the sling and the cover;
j. the pad have a hole therethrough which is positioned over the hole of the sling;
k. the portion of the retaining sheet which is received through the hole of the sling is also received through the hole of the pad; and/or
l. the cover include a layer of padding which is different from the pad.

In yet another aspect, there is provided a sling assembly for a Hoyer Lift comprising: (1) a sling for a Hoyer Lift having a hole therethrough for a patient's bottom; (2) a cover positioned above a top side of the sling, the cover having a hole therethrough which is positioned over the hole of the sling; (3) a retaining sheet having a hole therethrough which is positioned in alignment with the hole of the sling, a portion of the retaining sheet surrounding the hole of the retaining sheet being positioned on and attached to a top side of the cover; and (4) a pad positioned between the sling and the cover, the pad having a hole therethrough which is positioned over the hole of the sling. At least a portion of the retaining sheet is received through the hole of the cover and through the hole of the pad and the hole of the sling so that this portion of the retaining sheet is positioned beneath the bottom side of the sling. The cover and the portion of the retaining sheet positioned beneath the bottom side of the sling each extend beyond the width of the sling. An outer edge portion of the retaining sheet is attached to an outer edge portion of the cover to retain the sling and the pad between the cover and the retaining sheet.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
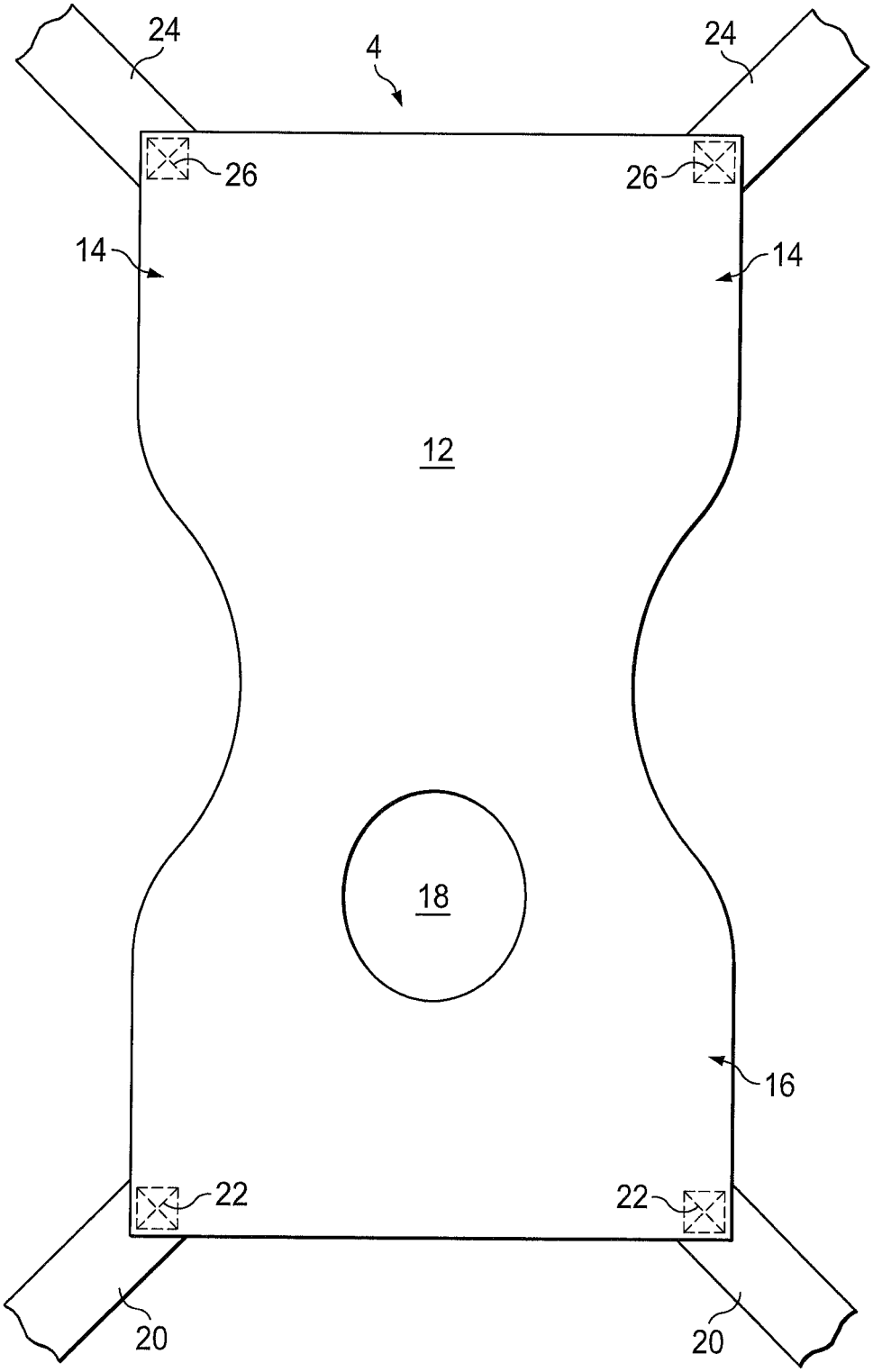
FIG. 1 is a top view of a typical sling 4 for use with a Hoyer Lift.

An embodiment 2 of the inventive apparatus and system for covering a Hoyer Lift sling piece 4 is illustrated in FIGS.

1-10. The inventive covering system 2 preferably comprises: a pad 6; a padded cover piece 8; and a retaining sheet 10 which is connected to the padded cover piece 6.

Figure 10:
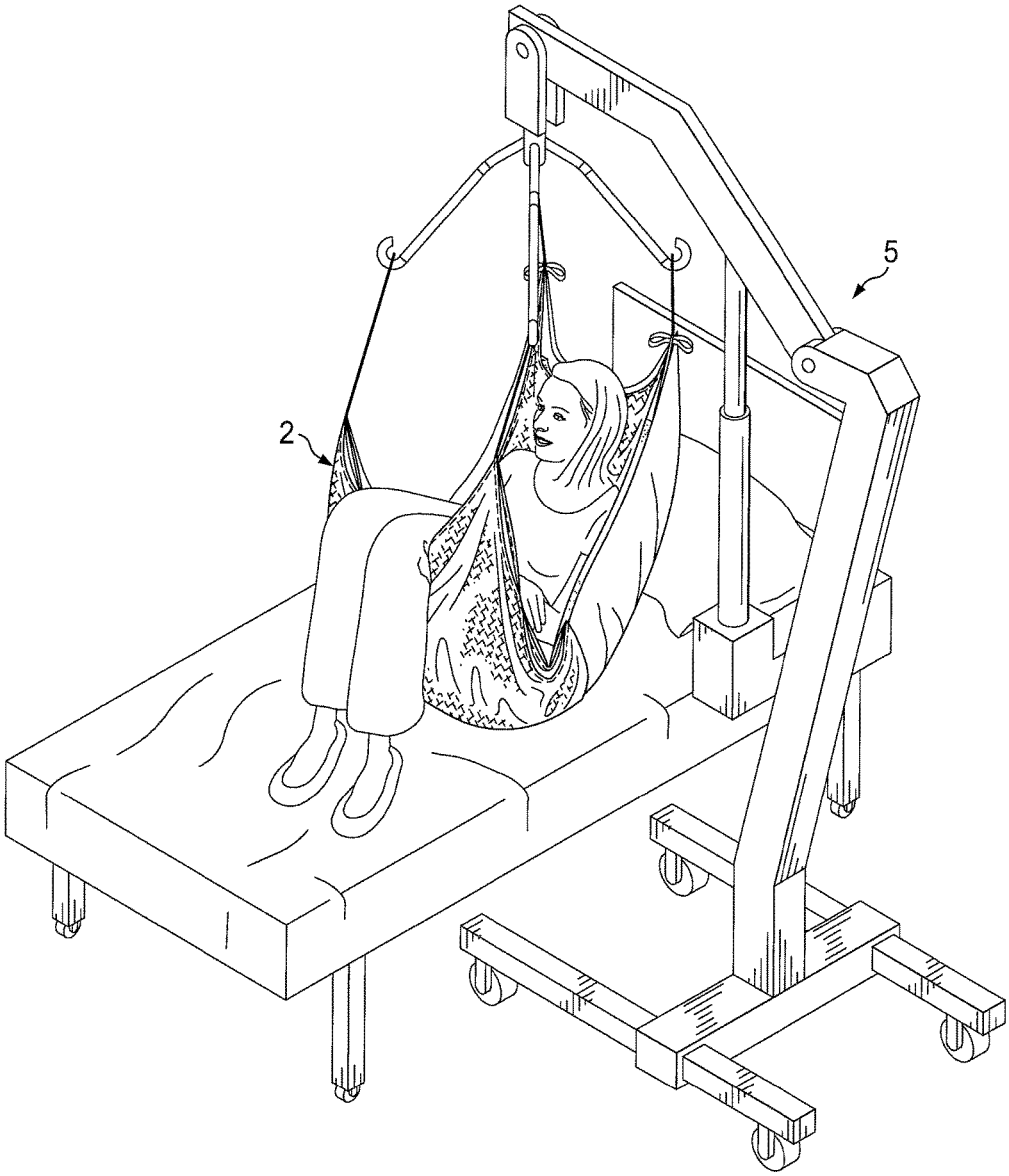
FIG. 10 illustrates the use of the inventive sling assembly 2 with a Hoyer Lift 5.

The inventive covering system 2 can be adapted for use on a Hoyer Lift sling 4 of generally any type or shape. An example of a lift sling 4 is illustrated in FIG. 1. The lift sling 4 comprises: a top side 12; an upper half 14; a lower half 16; a hole 18 in which the patient's bottom will be positioned; a pair of straps or other attachments 20 extending from the outer edges 22 of the lower half 16 of the sling 4 for attaching the lower half 16 to the Hoyer Lift 5 (see FIG. 10); and a pair of straps or other attachments 24 extending from the outer edges 26 of the upper half 14 of the sling 4 for attaching the upper half 14 to the Hoyer Lift 5.

Figure 2:
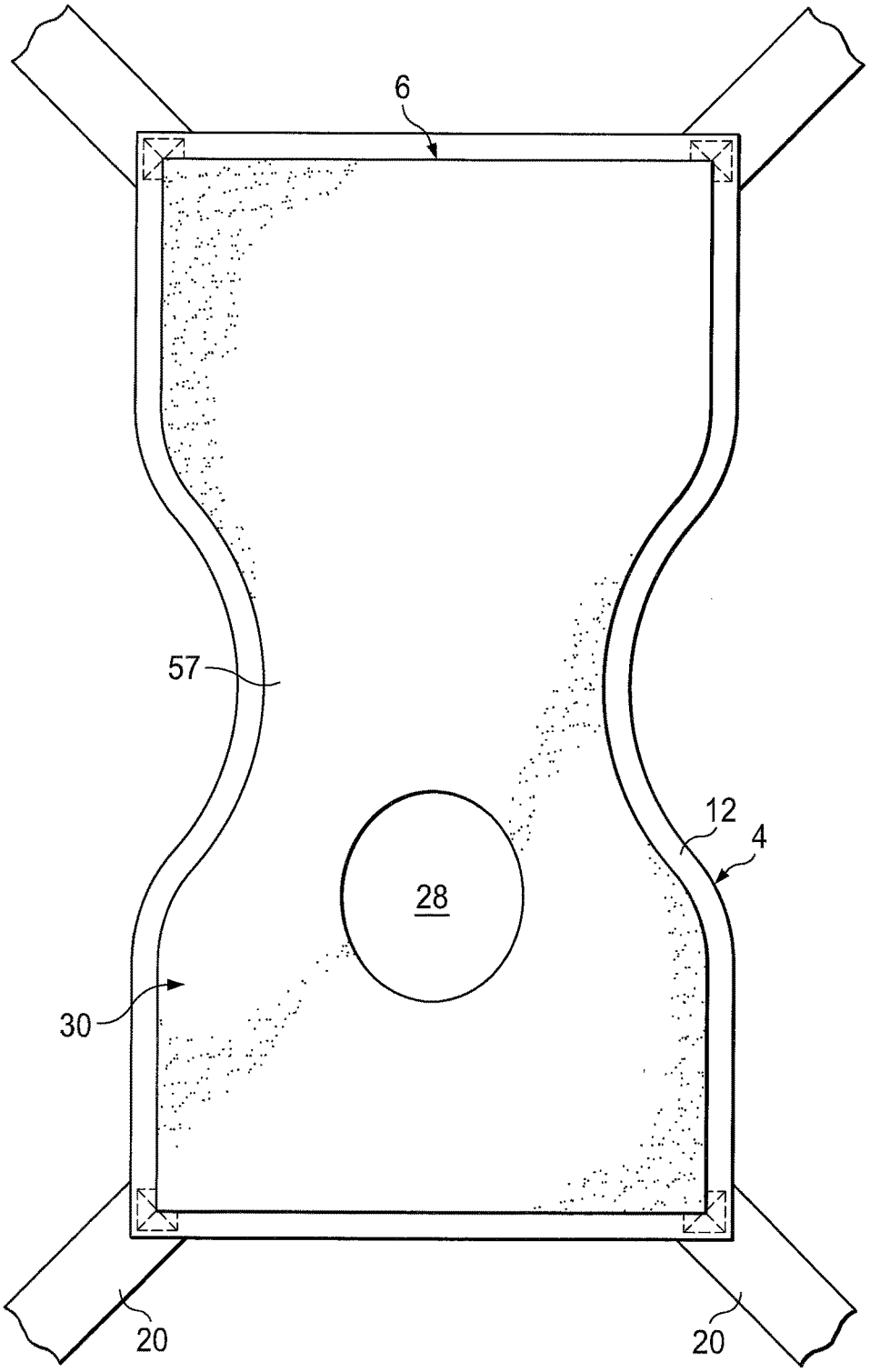
FIG. 2 is a top view of a pad 6 used in the inventive assembly 2. The pad 6 is placed on the top side of the lift sling 4.

The pad 6 of the inventive covering system 2 is shown in FIG. 2 resting on the top side 12 of the lift sling 4. The pad 6 is preferably substantially the same shape as the lift sling 4 and is preferably substantially the same size as, or slightly larger than, the lift sling 4. The pad 6 includes a hole 28 in the lower half 30 thereof which is positioned over and is substantially the same size as, or preferably a bit smaller than (i.e., from about 3% to about 15% smaller than), the hole 18 of the lift sling piece 4. The pad 6 can be formed of generally any type of padding material and will preferably be a piece of mattress foam padding.

Figure 3:
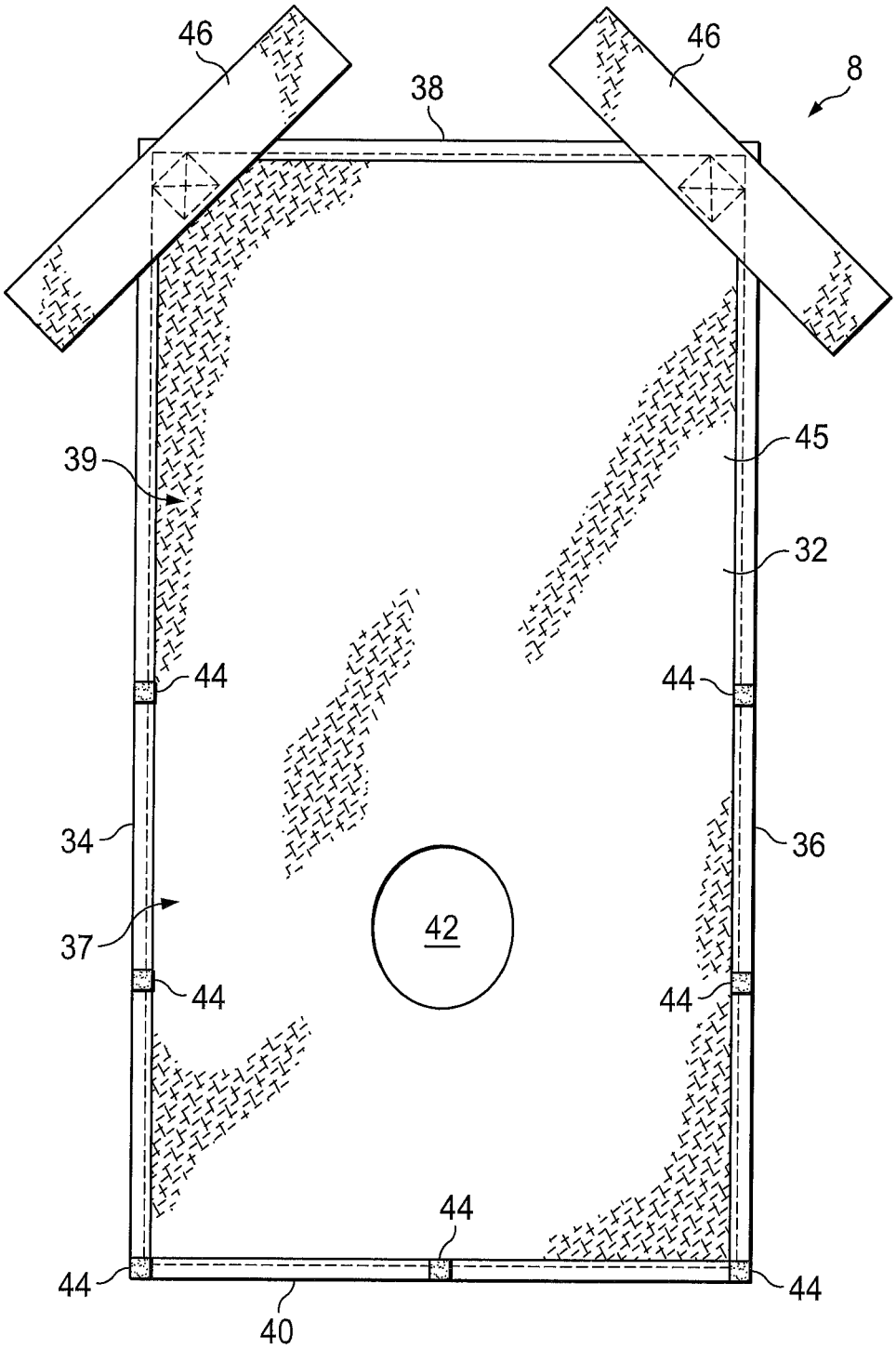
FIG. 3 is a bottom view of a padded cover piece 8 used in the inventive assembly 2.
Figure 4:
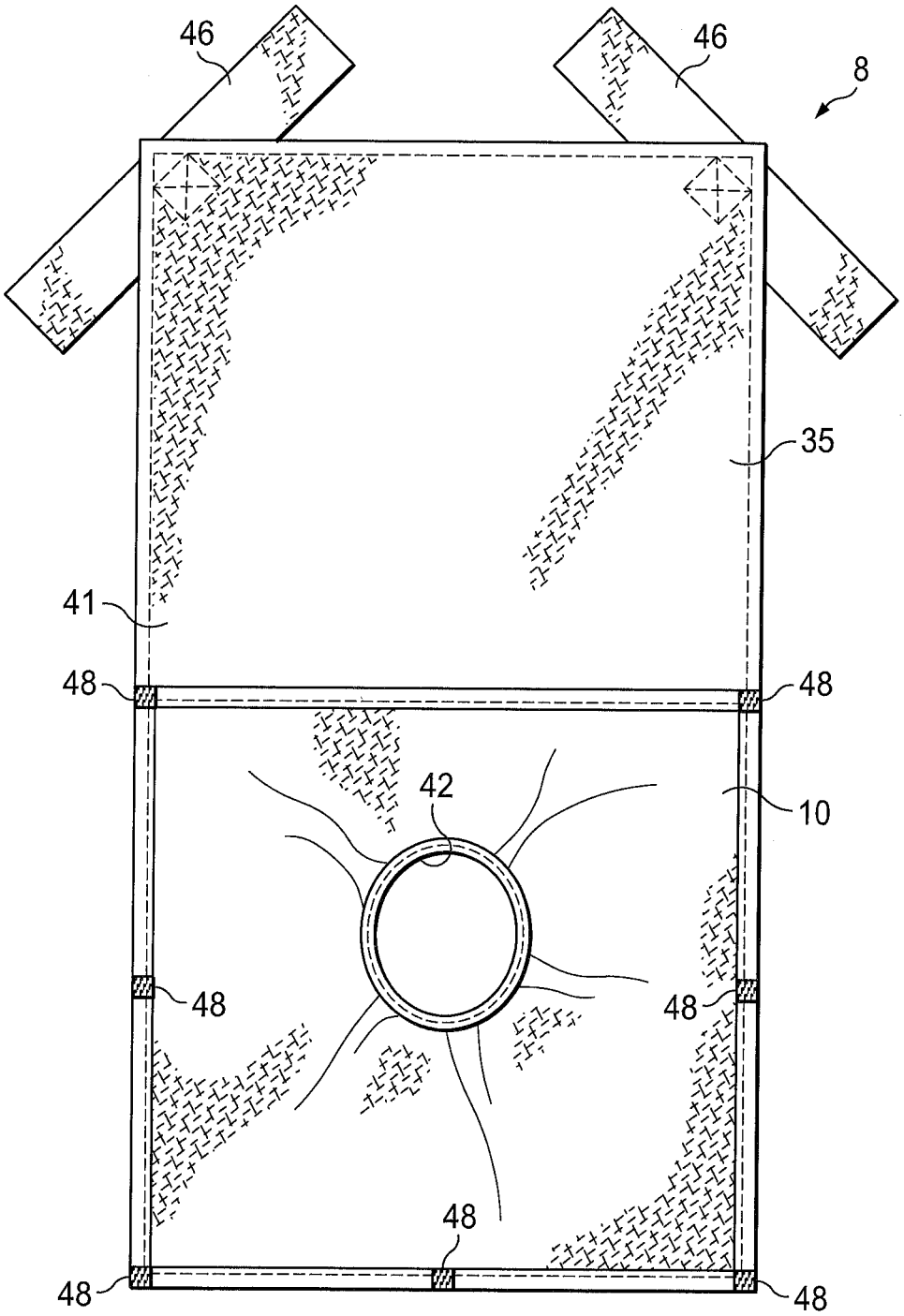
FIG. 4 is a top view of the padded cover piece 8 having a retaining sheet 10 attached thereto.

A bottom view of the padded cover piece 8 is provided in FIG. 3 and a top view of the padded cover piece 8 is provided in FIG. 4. The padded cover piece 8 preferably has a rectangular shape with a length and width which are greater than (i.e., will extend beyond) the maximum length and width of the lift sling 4 and the pad 6. The padded cover piece 8 preferably comprises: a rectangular pad 32 which is preferably of the same type as a mattress pad formed of cotton or other fabric; a rectangular cover sheet 35 which covers the top side of the rectangular pad 32 and has longitudinal side edges 34 and 36 and lateral top and bottom edges 38 and 40 which extend over the corresponding edges of the rectangular pad 32 and are attached to the bottom side 45 of the rectangular pad 32 by sewing, gluing, and/or any other attachment desired; a hole 42 provided through the lower half of padded cover piece 8 which corresponds to the hole 18 of the lift sling 4; Velcro attachments 44 provided on the side and bottom edges and on the bottom corners of the lower half 37 of the bottom side 45 of the padded cover piece 8; and ties or other attachments 46 provided at the upper corners of the padded cover piece 8 for tying or otherwise securing the upper half 39 of the padded cover piece to the upper attachment straps 20 of the lift sling 4.

The retaining sheet 10 of the inventive cover system 2 is a rectangular sheet of material which is positioned on the lower half 37 of the top side 35 of the rectangular cover sheet 35 of the padded cover piece 8. The retaining sheet 10 has a hole 46 provided therethrough which is preferably the same size as and is positioned on the hole 42 of the padded cover piece 8. The retaining sheet 10 also has Velcro attachments 48 on the top side 47 thereof on the side and lower edges of the retaining sheet 10 and on the lower corners thereof. The retaining sheet 10 is preferably only attached (most preferably sewn) to the top side 41 of the padded cover piece 8 at the edge 50 which surrounds the hole 46.

Figure 5:
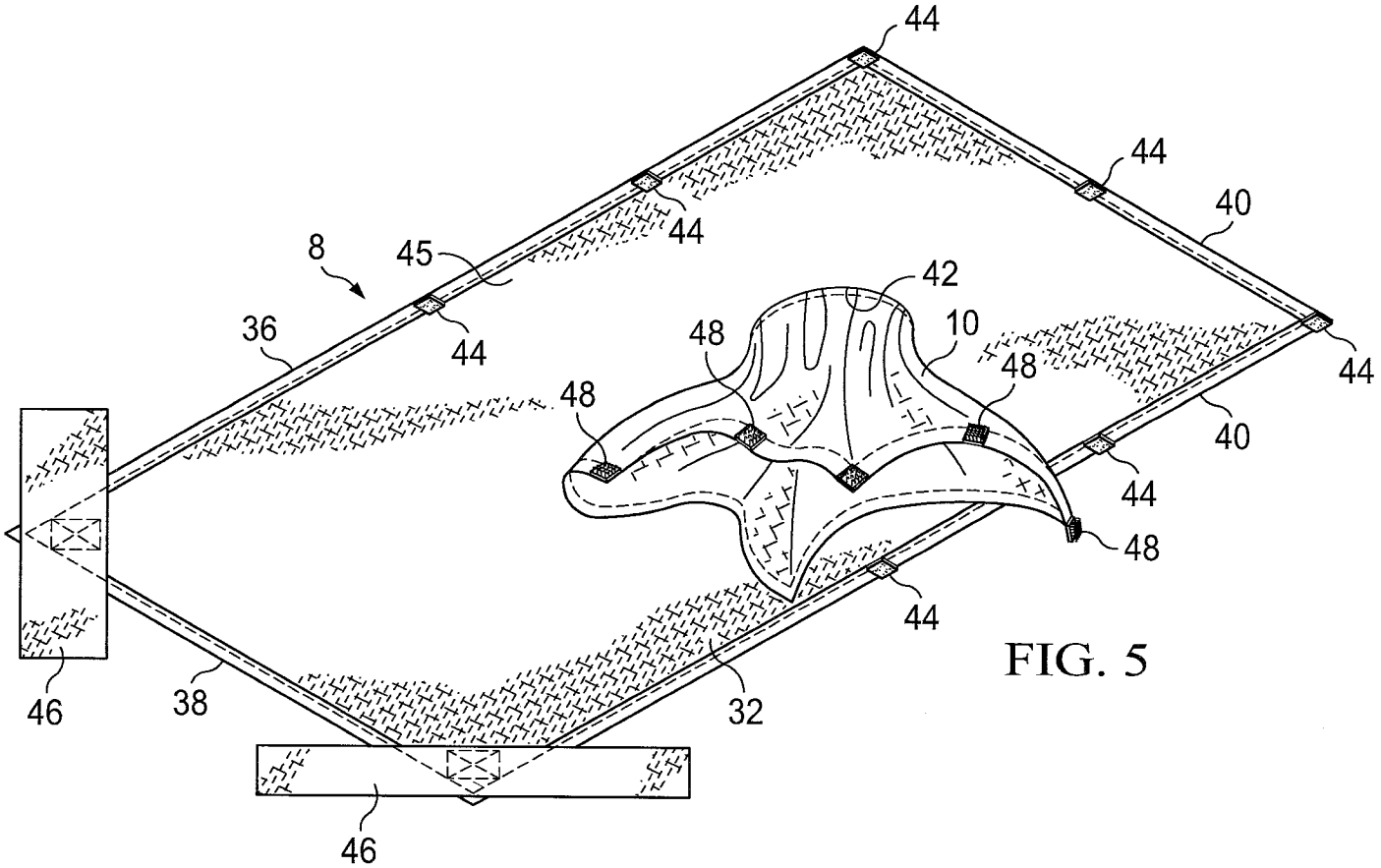
FIG. 5 is a bottom perspective view of the padded cover piece 8 with the retaining sheet 10 being pulled through the hole 42 of the cover piece 8.
Figure 6:
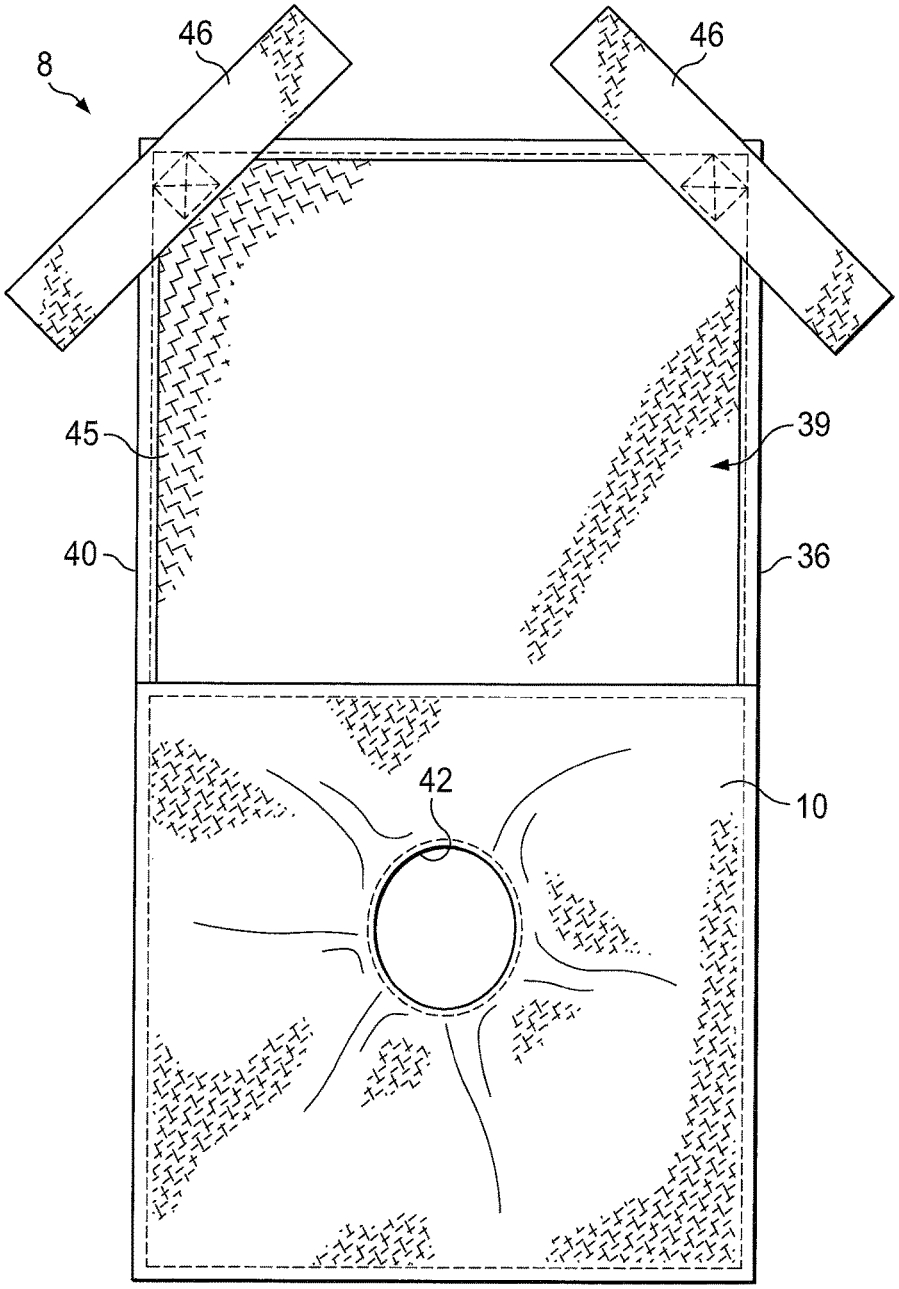
FIG. 6 is a bottom view of the padded cover piece 8 wherein the retaining sheet 10 has been pulled through the hole 42 of the padded cover piece 8 and is now positioned on the bottom the cover piece 8.
Figure 7:
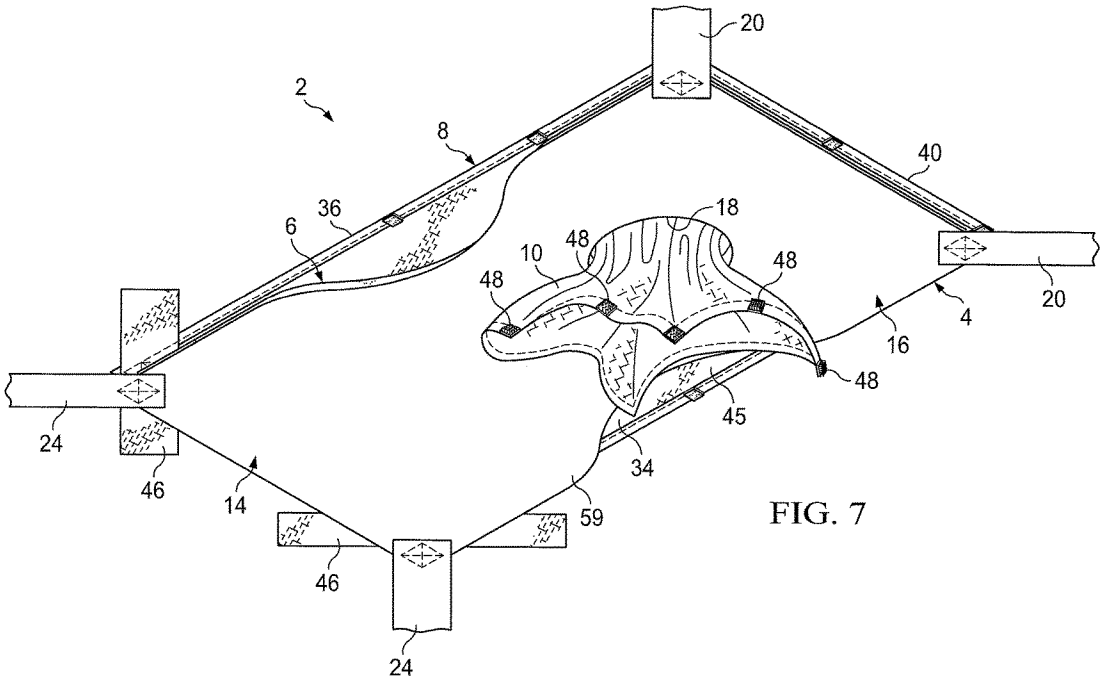
FIG. 7 is a bottom perspective view of the inventive assembly 2 with the cover piece 8 placed on top of the pad 6 and the retaining sheet being pulled through the hole 28 of the pad 6 and through the hole 18 of the lift sling 4.
Figure 8:
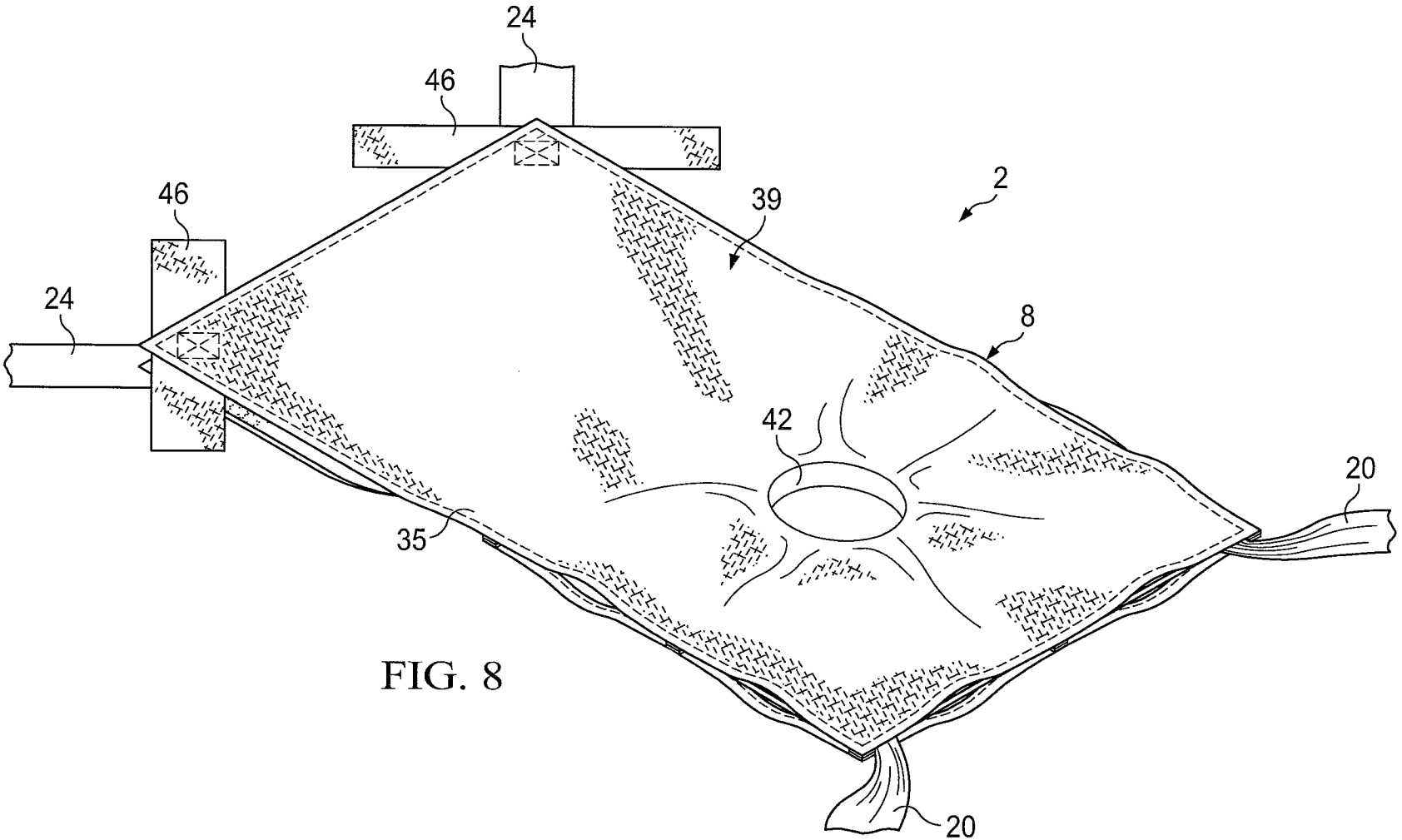
FIG. 8 is a top perspective view of the inventive assembly 2.
Figure 9:
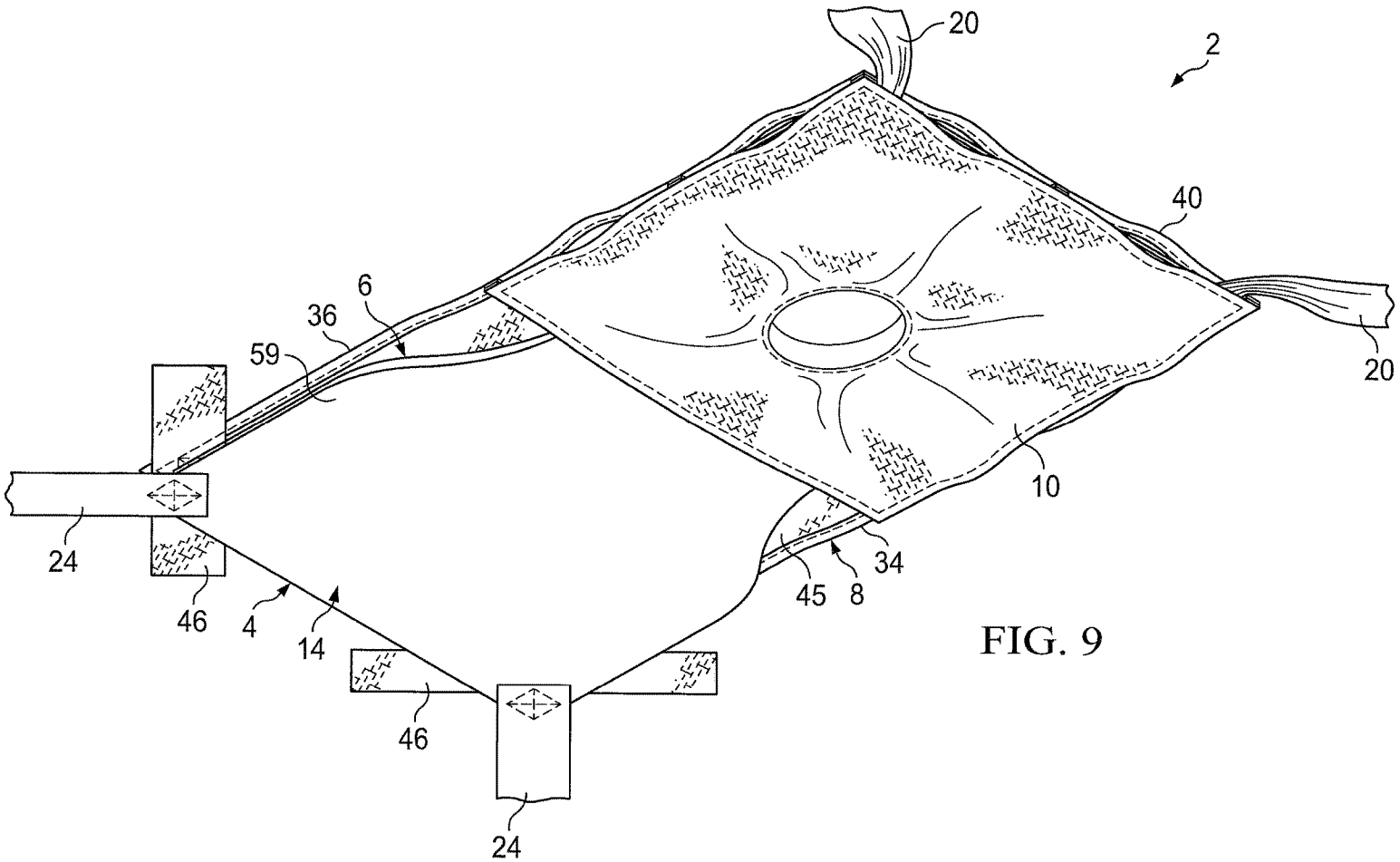
FIG. 9 is a bottom perspective view of the inventive assembly 2.

The method of the present invention for forming the inventive Hoyer sling assembly 2 is illustrated in FIGS. 2 and 5-9. As shown in FIG. 2, the pad 6 is placed on the top side 12 of the lift sling 4. As illustrated in FIG. 5, the retaining sheet 10 attached to the top side 37 of the padded cover piece 8 is pulled through the hole 42 of the padded cover piece 8 so that it is now positioned on the bottom side 45 of the padded cover piece 8 as shown in FIG. 6. As illustrated in FIG. 7, the bottom side 45 of the padded cover piece 8 is then positioned over the top side 57 of the pad 6 and the retaining sheet 10 attached to the padded cover piece 8 is pulled through the hole 28 of the pad 6 and then through the hole 18 of the lift sling 4. With the retaining sheet 10 now positioned on the bottom side 59 of the lift sling 4, the Velcro attachments 48 of the retaining sheet 10 are removably attached to the correspondingly positioned Velcro attachments 44 on the bottom side 45 of the cover piece, thus forming the inventive padded sling and cover assembly 55 as shown in FIG. 8 (top view) and in FIG. 9 (bottom view).

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. A sling assembly for a Hoyer Lift comprising:

a sling for a Hoyer Lift having a hole therethrough for a patient's bottom;

a cover positioned above a top side of the sling, the cover having a hole therethrough which is positioned over the hole of the sling; and a retaining sheet attached to the cover and having a hole therethrough which is positioned in alignment with the hole of the sling, wherein at least a portion of the retaining sheet is received through the hole of the sling so that the portion of the retaining sheet is positioned beneath a bottom side of the sling, the retaining sheet is permanently attached to the cover at least partially around the hole of the retaining sheet, the cover positioned above the top side of sling and the portion of the retaining sheet positioned beneath the bottom side of the sling each extend beyond a width of the sling, and an outer edge portion of the retaining sheet is attached to an outer edge portion of the cover to retain the sling between the cover and the retaining sheet.

2. The sling assembly of claim 1 wherein the retaining sheet is permanently attached to the cover by sewing at least partially around the hole of the retaining sheet.

3. The sling assembly of claim 1 wherein the outer edge portion of the retaining sheet is removably attached to the outer edge portion of the cover by Velcro attachment.

4. The sling assembly of claim 1 wherein the cover is padded.

5. The sling assembly of claim 1 wherein:

a portion of the retaining sheet surrounding the hole of the retaining sheet is positioned on and attached to a top side of the cover and the portion of the retaining sheet received through the hole of the sling is also received through the hole of the cover.

6. The sling assembly of claim 5 wherein the portion of the retaining sheet surrounding the hole of the retaining sheet is sewn to the top side of the cover.

7. The sling assembly of claim 1 wherein:

the sling assembly further comprises a pad positioned between the sling and the cover;

the pad has a hole therethrough which is positioned over the hole of the sling; and the portion of the retaining sheet received through the hole of the sling is also received through the hole of the pad.

8. The sling assembly of claim 7 wherein the cover includes a layer of padding which is different from the pad.

9. A sling assembly for a Hoyer Lift comprising:

a sling for a Hoyer Lift having a hole therethrough for a patient's bottom;

a cover positioned above a top side of the sling, the cover having a hole therethrough which is positioned over the hole of the sling;

a retaining sheet having a hole therethrough which is positioned in alignment with the hole of the sling, a portion of the retaining sheet surrounding the hole of the retaining sheet being positioned on and attached to a top side of the cover; and a pad positioned between the sling and the cover, the pad having a hole therethrough which is positioned over the hole of the sling, wherein at least a portion of the retaining sheet is received through the hole of the cover, the hole of the pad, and the hole of the sling so that the portion of the retaining sheet is positioned beneath a bottom side of the sling, the cover extends beyond a width of the sling, the portion of the retaining sheet positioned beneath the bottom side of the sling extends beyond the width of the sling, and an outer edge portion of the retaining sheet is attached to an outer edge portion of the cover to retain the sling and the pad between the cover and the retaining sheet.

* * * * *